US012134004B2

(12) United States Patent
Best

(10) Patent No.: US 12,134,004 B2
(45) Date of Patent: Nov. 5, 2024

(54) PORTABLE ABDOMINAL WORKOUT EQUIPMENT AND ASSOCIATED SYSTEMS AND METHODS

(71) Applicant: Daniel Best, Columbus, GA (US)

(72) Inventor: Daniel Best, Columbus, GA (US)

( * ) Notice: Subject to any disclaimer, the term of this patent is extended or adjusted under 35 U.S.C. 154(b) by 191 days.

(21) Appl. No.: 17/737,240

(22) Filed: May 5, 2022

(65) Prior Publication Data

US 2023/0356023 A1 Nov. 9, 2023

(51) Int. Cl.
*A63B 21/00* (2006.01)

(52) U.S. Cl.
CPC ..... *A63B 21/4047* (2015.10); *A63B 21/4033* (2015.10)

(58) Field of Classification Search
CPC ..... A63B 21/4029; A63B 21/4031; A63B 21/4037
See application file for complete search history.

(56) References Cited

U.S. PATENT DOCUMENTS

| | | | | |
|---|---|---|---|---|
| 6,454,683 | B1 * | 9/2002 | Kaye | A63B 71/0036 482/904 |
| 9,248,337 | B1 * | 2/2016 | Humphrey | A63B 21/00181 |
| 9,713,740 | B1 * | 7/2017 | Chen | A63B 21/4033 |
| 9,750,971 | B1 * | 9/2017 | Humphrey | A63B 21/00181 |
| 10,518,129 | B2 * | 12/2019 | Raiten | A63B 21/4015 |
| 10,561,562 | B1 * | 2/2020 | Erb | A63B 24/0087 |
| 2017/0100622 | A1 * | 4/2017 | Wall | A63B 21/4029 |
| 2017/0259109 | A1 * | 9/2017 | McJames, II | A63B 22/0015 |
| 2019/0126122 | A1 * | 5/2019 | Vester | A63B 71/0036 |
| 2023/0048783 | A1 * | 2/2023 | Miller | A63B 21/078 |

* cited by examiner

*Primary Examiner* — Zachary T Moore
(74) *Attorney, Agent, or Firm* — Kilpatrick Townsend & Stockton LLP

(57) ABSTRACT

A portable exercise device for exercising abdominal muscles includes a base and at least one support. The base includes a front end, a back end, and a top side between the front end and the back end. The support includes a front end, a back end, and a top side between the front end and the back end of the support. The support is pivotably attached to the base and has a range of motion relative to the base, and the top side of the base and the top side of the support together define a sitting surface for a user.

16 Claims, 7 Drawing Sheets

PORTABLE ABDOMINAL WORKOUT EQUIPMENT AND ASSOCIATED SYSTEMS AND METHODS

FIELD OF THE INVENTION

This application relates to systems and methods for exercising, and more particularly to systems and methods for exercising abdominal muscles.

BACKGROUND

Abdominal muscles are often the target of various exercises in order to develop a defined and strengthened core as well as to promote health and wellness. Traditionally, standalone exercises, or exercises without equipment such as sit-ups and crunches, have been used to exercise abdominal muscles. While some exercise equipment has been developed to target abdominal muscles, such equipment is often large and difficult to operate and cannot be easily moved to various locations or in settings outside of a gym or fitness center.

SUMMARY

Embodiments covered by this patent are defined by the claims below, not this summary. This summary is a high-level overview of various embodiments and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain embodiments, a portable exercise device includes a base having a front end, a back end, and a top side between the front end and the back end. The top side may include a support recess extending from the front end to a position between the front end and the back end. The portable exercise device also includes a support at least partially positioned within the support recess. The support is pivotable through a range of motion between a first position and a second position relative to the base. A top side of the support and a portion of the top side of the base define a sitting surface for a user.

According to some embodiments, an exercise device includes a base and a support. The base includes a front end, a back end, and a top side between the front end and the back end. The support includes a front end, a back end, and a top side between the front end and the back end of the support. The support is pivotably attached to the base and movable between a minimum angle and a maximum angle relative to the base, and the top side of the base and the top side of the support together define a sitting surface.

According to various embodiments, an exercise device includes a base, a first support, and a second support. The base includes a front end, a back end, a first side between the front end and the back end, a second side opposite the front end, and a top side between the front end and the back end. The first support is pivotably attached to the base between the front end and the back end, and the second support is pivotably attached to the base between the front end and the back end and between the first support and the second side of the base. The first support and the second support each includes a range of motion relative to the base, and the top side of the base, a top side of the first support, and a top side of the second support together define a sitting surface for a user.

Various implementations described herein may include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The specification makes reference to the following appended figures, in which use of like reference numerals in different figures is intended to illustrate like or analogous components.

DETAILED DESCRIPTION

The subject matter of embodiments is described herein with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "bottom," "left," "right," "front," and "back," among others, are intended to refer to the orientation as illustrated and described in the figure (or figures) to which the components and directions are referencing. As used herein, the meaning of "a," "an," and "the" includes singular and plural references unless the context clearly dictates otherwise.

All ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10.

Described herein are exercise devices for exercising muscles in abdominal and/or thigh areas. The exercise devices provided herein may define a sitting surface that a user may sit on when using the device and the exercise devices may provide resistance to a thigh-lowering movement by a user. In some embodiments, the exercise devices provided herein optionally allow for isolation of a user's left thigh or right thigh, although it need not in other embodiments. In certain embodiments, the exercise devices provided herein are portable and may be easily carried and/or used by a user in various locations as desired. The exercise devices provided herein may thus have various features facilitating portability, including but not limited to various types of handles and/or materials. Various other benefits and advantages may be realized with the systems and methods provided herein, and the aforementioned advantages should not be considered limiting.

Figure 1:
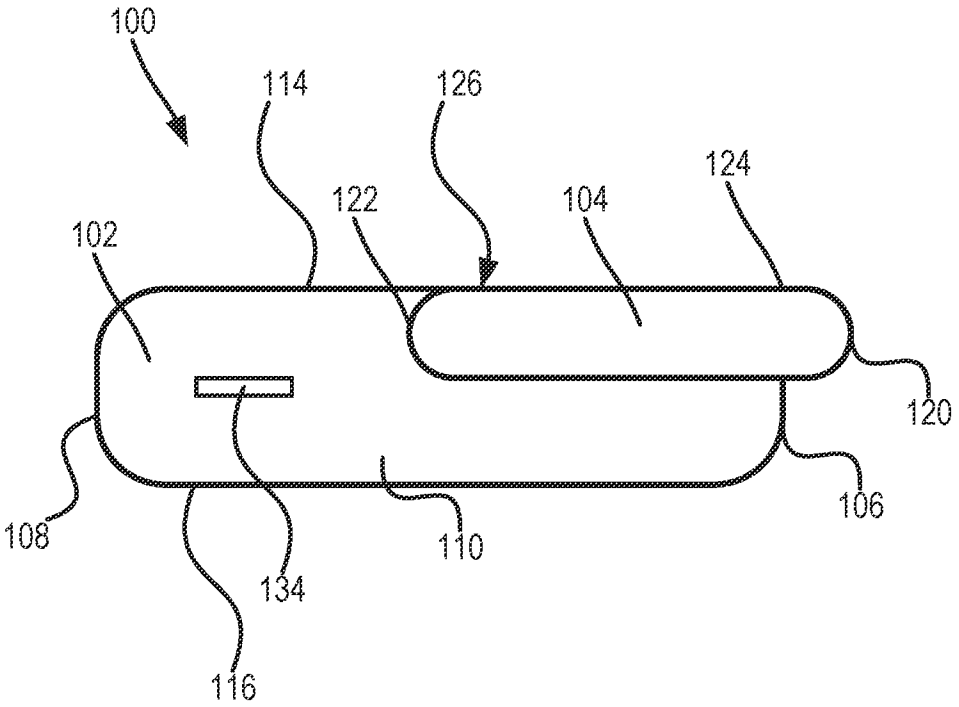
FIG. 1 is a side view of an exercise device with a base and a support and with the support in a first position relative to the base according to embodiments.
Figure 2:
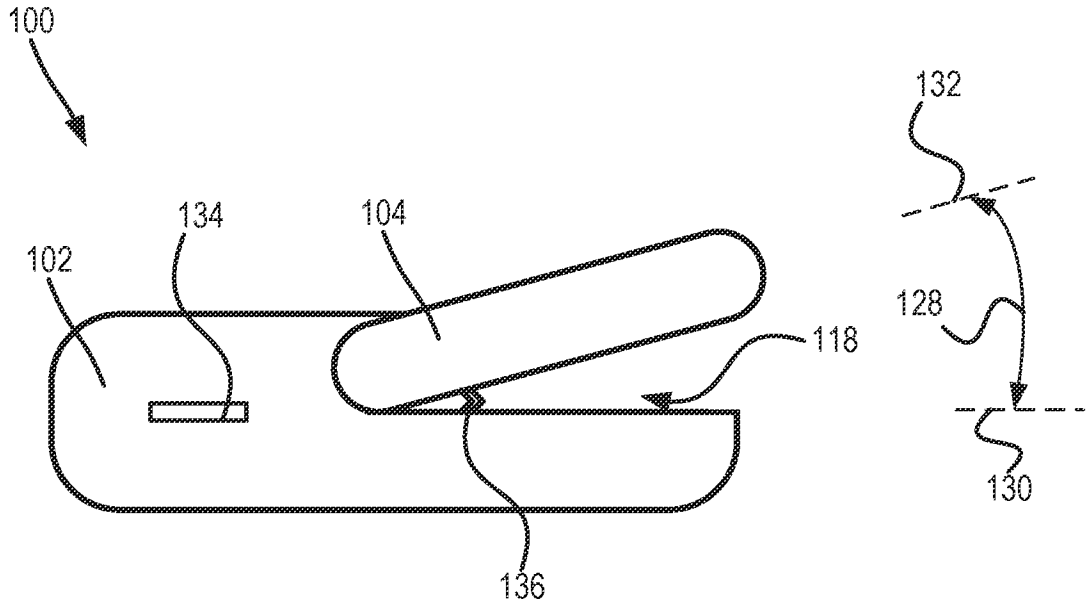
FIG. 2 is side view of the exercise device of FIG. 1 with the support in a second position relative to the base.
Figure 3:
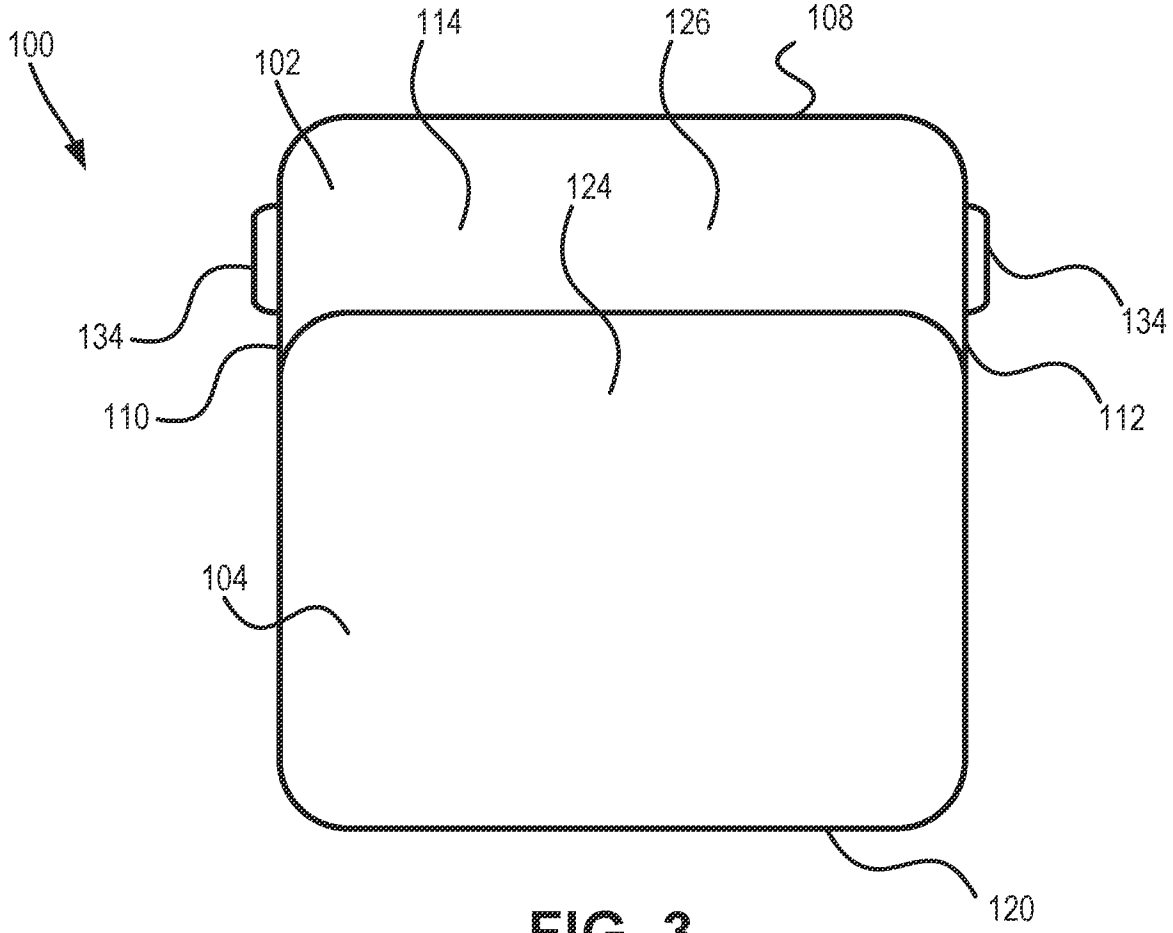
FIG. 3 is a top view of the exercise device of FIG. 1.

FIGS. 1-3 illustrate an example of an exercise device 100 according to various embodiments. The exercise device 100 includes a base 102 and at least one support 104. In the embodiment of FIGS. 1-3, the exercise device includes a single support 104.

In the embodiment of FIGS. 1-4, the base 102 includes a front end 106, a back end 108, a first side 110, a second side 112, a top side 114, and a bottom side 116. However, the particular shape of the base 102 should not be considered limiting, and in other embodiments, the base 102 may have other shapes as desired. The base 102 may be constructed from various materials as desired, including but not limited to various plastics, metals, composites, combinations thereof, and/or other materials as desired. In some embodiments, the base 102 is constructed from a material suitable for supporting a predetermined weight. As one non-limiting example, the base 102 may support a user having a weight up to at least 400 lbs., although in other embodiments the predetermined weight may be other weights as desired. In various embodiments, the base 102 is constructed from a lightweight material facilitating portability of the exercise device 100. Optionally, one or more handles 134 may be provided on the base 102 for facilitating portability of the exercise device 100. In the embodiment illustrated, handles 134 are provided on each of the sides 110, 112; however, the number, type, and location of the handles 134 should not be considered limiting.

As best illustrated in FIG. 2, in some embodiments, the top side 114 includes a support recess 118 for receiving the support 104. The support recess 118 may extend from the front end 106 to a position between the front end 106 and the back end 108—in other words, a length of the support recess 118 may be less than a length of the base 102. In some embodiments, the support recess 118 may extend from the first side 110 to the second side 112, although it need not in other embodiments. In some embodiments, and as best illustrated in FIG. 2, the support recess 118 optionally may extend from the top side 114 to a position between the top side 114 and the bottom side 116 (e.g., it does not extend completely through the base 102 in some optional embodiments).

The support 104 generally includes a front end 120, a back end 122, and a top side 124. Optionally, the support 104 may extend from the first side 110 to the second side 112 of the base 102, although it need not in other embodiments. The particular shape of the support 104 should not be considered limiting. In certain embodiments, the top side 124 of the support 104 and the top side 114 of the base 102 together define a sitting surface 126 that a user may sit on when using the exercise device 100. Optionally, one or more cushioning members or cushioning materials for the user may be provided on the sitting surface 126. When included, such cushioning members may be constructed from various suitable materials as desired and may be attached to the sitting surface using various mechanisms or techniques as desired.

The support 104 is pivotably coupled or connected to the base 102 using various techniques, devices, or mechanisms as desired. In certain embodiments, the support 104 is at least partially positioned within the support recess 118, and the support 104 may be pivotably connected to the base 102 at or proximate to the back end 122 of the support 104. In other embodiments, the support 104 may be pivotably connected to the base 102 at other locations as desired.

Referring to FIGS. 1 and 2, in certain embodiments, the support 104 is pivotably connected to the base 102 such that the support 104 has a range of motion (represented by arrow 128) between a first position 130 and a second position 132 relative to the base 102. FIG. 1 illustrates the support 104 in the first position 130, and FIG. 2 illustrates the support in the second position 132.

In some embodiments, in the first position 130, the support 104 is at a minimum angle relative to the base 102, and in the second position 132, the support 104 is at a maximum angle relative to the base 102. The first position 130 and the second position 132 may be various angles relative to the base as desired. In one non-limiting example, the support 104 in the first position 130 may extend at an angle of 0° relative to the base (e.g., a horizontal axis of the base), and the support 104 in the second position 132 may extend at an angle of 30° relative to the base. In other embodiments, the first position 130 and/or the second position 132 may be other angles as desired, including greater than 0°, less than 30°, and/or greater than 30°. In certain embodiments, in the first position 130, the support 104 and the base 102 may define a more planar sitting surface 126, and in the second position 132, the support 104 and the base 102 may define a more angled sitting surface 126. Optionally, and as illustrated in FIG. 1, in the first position 130, more of the support 104 may be positioned within the support recess 118 compared to the second position 132. Optionally, in the first position 130, the front end 120 of the support 104 may extend forward or outwards compared to the front end 106 of the base 102.

In various embodiments, the exercise device 100 includes a biasing device 136 or member that biases the support 104 relative to the base 102 and/or provides resistance to a downward movement of the support 104. In some embodiments, the biasing device 136 optionally may bias the support 104 towards the second position 132 and/or upwards relative to the base 102 as illustrated in FIG. 2. The biasing device 136 biasing the support 104 may provide resistance against a downward movement by the user (e.g., towards the base 102), and such resistance may be used to exercise the abdominal and/or thigh areas of the user. The biasing device 136 may be various suitable devices or mechanisms for providing resistance to downward movement (movement in the direction from the second position 132 to the first position 130). As one non-limiting example, the biasing device 136 may be one or more spring devices. Optionally, the resistance and/or biasing force provided by the biasing device 136 may be adjustable as desired. In such embodiments, the adjustable resistance may further allow for a user to adjust exercising of her or his muscles as desired.

In some embodiments, the first position 130 and/or the second position 132 may be adjustable as desired using various adjustment techniques or mechanisms. As a non-limiting example, the support 104 may include a range limiter with a plurality of preselected positions corresponding to predetermined angles relative to the base 102, and the user may lock and/or otherwise select one of the preselected positions to be the first position 130 and/or the second position 132. In other embodiments, other devices or mechanisms may be used as desired such that the first position 130 and/or the second position 132 are adjustable.

Referring to FIGS. 1 and 2, a method of using the exercise device 100 may include positioning the exercise device 100 on a support surface. In some non-limiting examples, the support surface may be the ground, a floor, a chair, and/or any other location as desired by the user. The user may sit on the sitting surface 126 of the exercise device 100 such that her or his upper thighs are positioned over and contacting the support 104. The biasing device 136 provides resistance to a downward movement of the support 104 towards the base 102, and thus to exercise, the user may push down on the support using her or his upper thighs to move the support 104 towards the first position 130. In certain embodiments, the exercise device 100 may automatically return to the second position 132 when the user stops pushing down on the support 104. As mentioned, the range of motion 128 and/or the resistance provided by the biasing device 136 may be adjustable as desired by the user.

Figure 4:
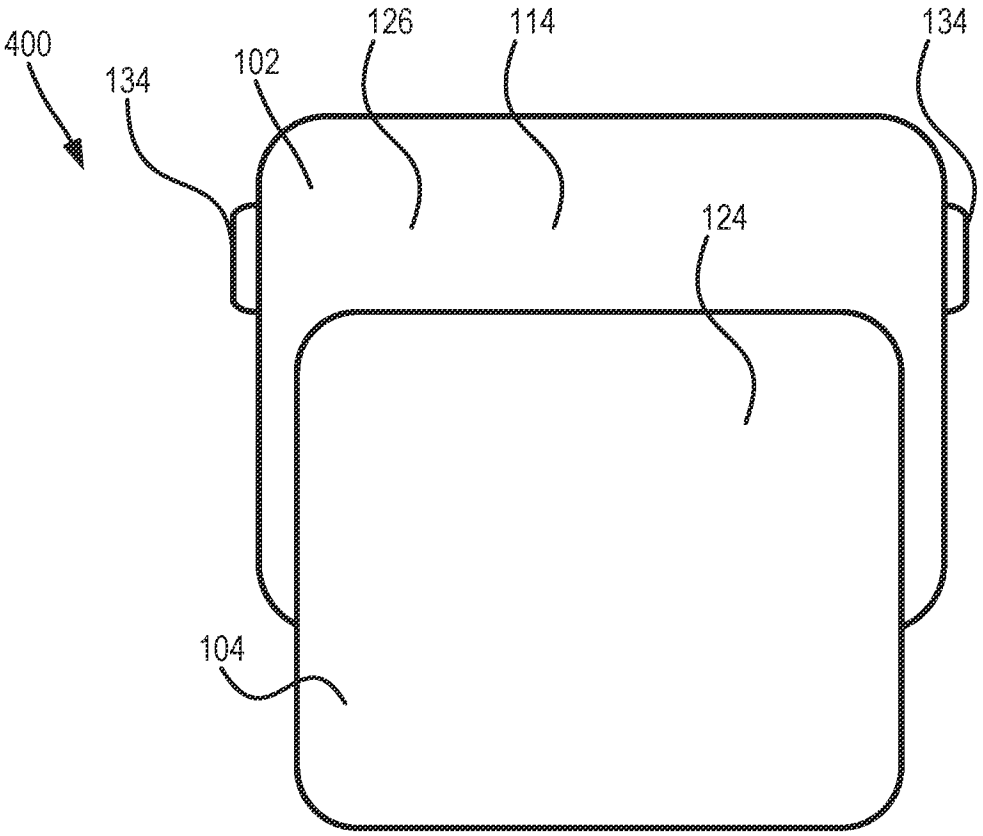
FIG. 4 is a top view of another exercise device according to embodiments.
Figure 5:
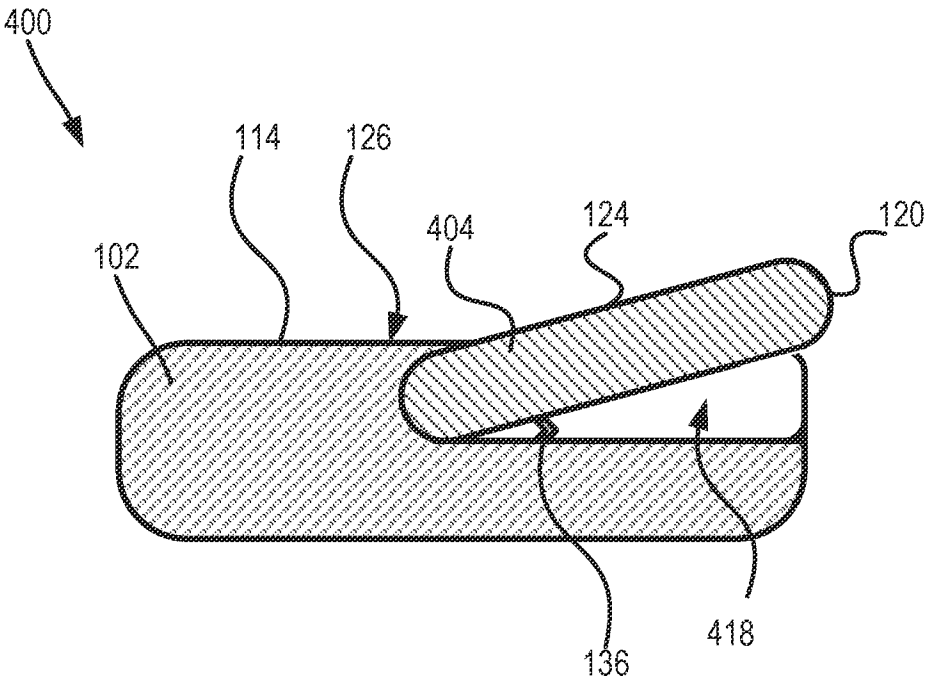
FIG. 5 is a sectional view of the exercise device of FIG. 4.

FIGS. 4 and 5 illustrate another example of an exercise device 400 according to various embodiments. The exercise device 400 is substantially similar to the exercise device 100 except that a support recess 418 does not extend entirely between the sides 110, 112 of the base (e.g., the support recess 418 is narrower compared to the support recess 118). In these embodiments, a support 404 of the exercise device 400 is substantially similar to the support 104 except that the support 404 is narrower compared to the support 104.

Figure 6:
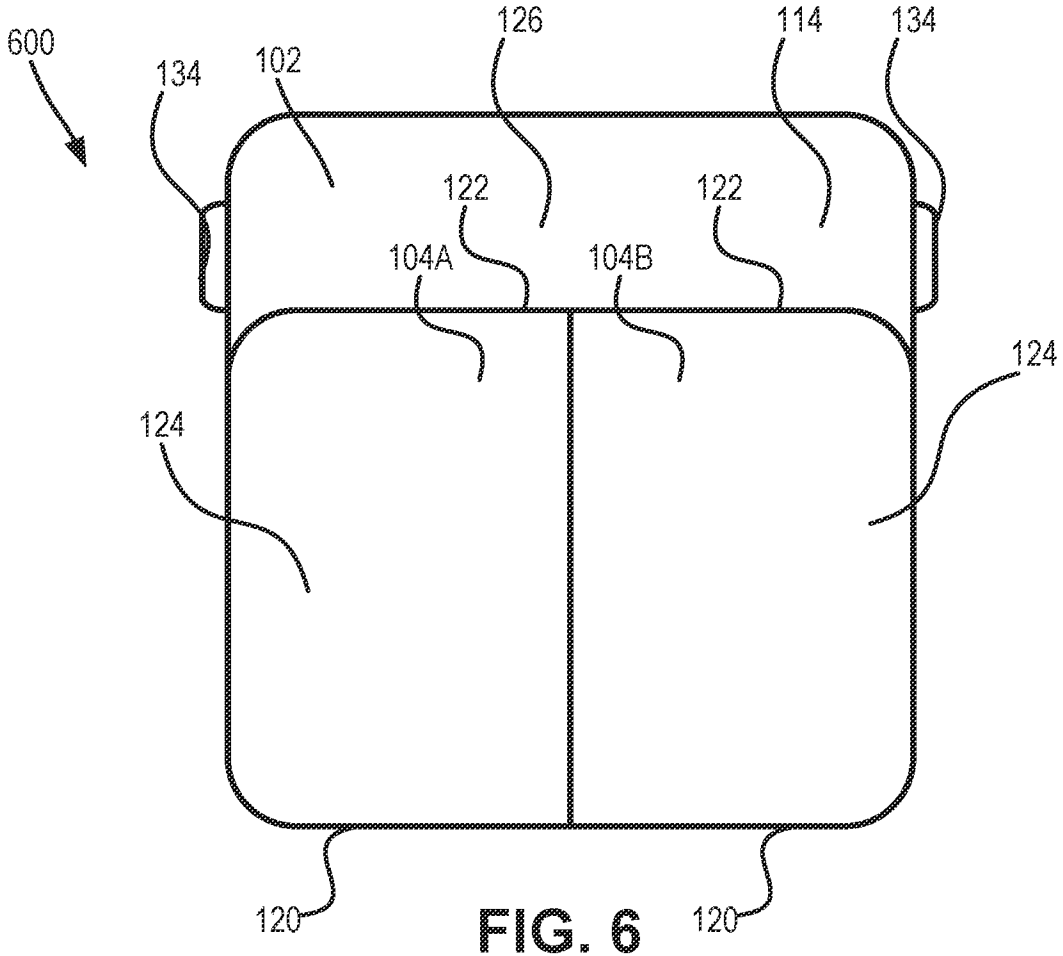
FIG. 6 is a top view of another exercise device according to embodiments.
Figure 7:
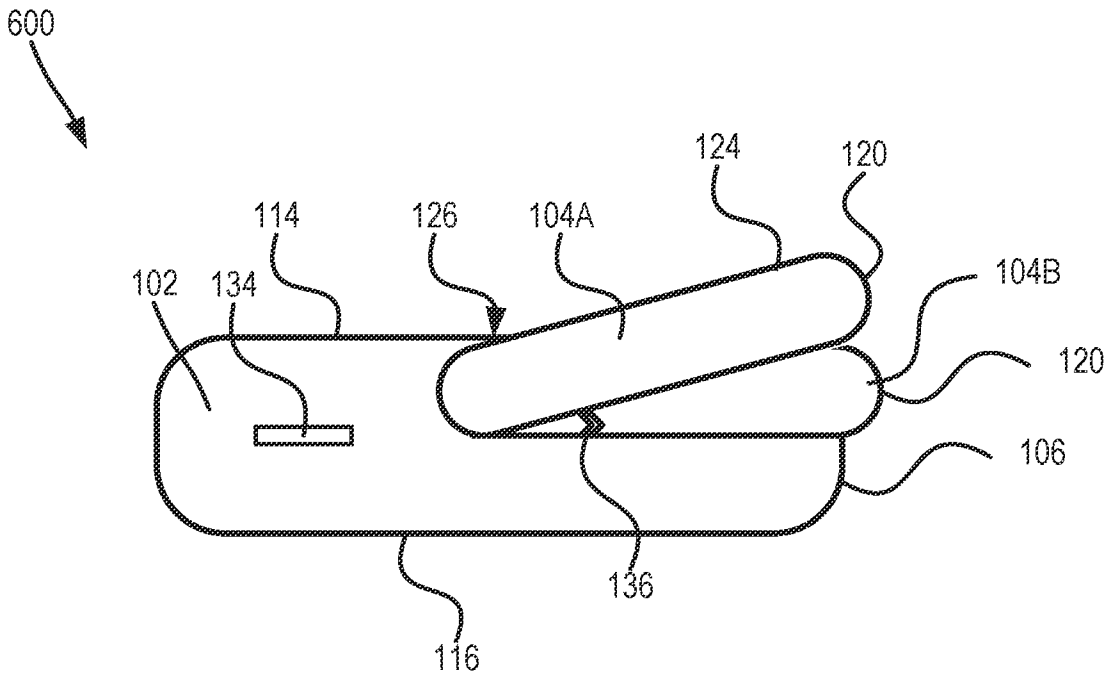
FIG. 7 is a side view of the exercise device of FIG. 6.

FIGS. 6 and 7 illustrate another example of an exercise device 600 according to embodiments. The exercise device 600 is similar to the exercise device 100 except that the exercise device 600 includes two supports 104A-B. As best illustrated in FIG. 6, the support 104A is provided between the sides 110, 112, and the support 104B is provided between the support 104A and the second side 112. Similar to the support 104 of the exercise device 100, the supports 104A-B are pivotably connected to the base 102. In certain embodiments, each support 104A-B is independently pivotable relative to the base 102. In such embodiments, the independent movement may allow for isolated training of the user's left thigh and/or right thigh as desired, and/or may allow for the user to perform various combinations of movements of the supports 104A-B as desired. Optionally, a locking device may be provided to selectively lock the supports 104A-B such that the supports 104A-B are movable together.

In some embodiments, the range of motion and/or the resistance for the supports 104A-B may be the same, although they need not be in other embodiments. In certain cases, the range of motion and/or the resistance of the supports 104A-B may be independently adjustable as desired. As a non-limiting example, the support 104A may be adjusted to have a greater range of motion compared to the support 104B and/or the support 104B may be adjusted to provide greater resistance to the user compared to the support 104A.

Various other exercise devices with different shapes and/or different combinations of supports with bases may be used as desired, and the aforementioned examples should not be considered limiting. As previously mentioned, the exercise devices provided herein are portable and allow for a user to use the device in any location as desired. Moreover, the base with the at least one support may allow for improved exercising of at least a user's lower abdominal muscles and/or upper thigh muscles, among other potential uses.

A collection of exemplary embodiments are provided below, including at least some explicitly enumerated as "Illustrations" providing additional description of a variety of example embodiments in accordance with the concepts described herein. These illustrations are not meant to be mutually exclusive, exhaustive, or restrictive; and the disclosure not limited to these example illustrations but rather encompasses all possible modifications and variations within the scope of the issued claims and their equivalents.

Illustration 1. A portable exercise device comprising: a base comprising a front end, a back end, and a top side between the front end and the back end, wherein the top side comprises a support recess extending from the front end to a position between the front end and the back end; and a support at least partially positioned within the support recess, wherein the support is pivotable through a range of motion between a first position and a second position relative to the base, wherein a top side of the support and a portion of the top side of the base define a sitting surface for a user.

Illustration 2. The portable exercise device of any preceding or subsequent illustrations or combination of illustrations, wherein, in the first position, the support extends at an angle of 0° relative to the base, and wherein, in the second position, the support extends at an angle of 30° relative to the base.

Illustration 3. The portable exercise device of any preceding or subsequent illustrations or combination of illustrations, wherein the base further comprises a first side and a second side extending between the front end and the back end, and wherein the portable exercise device further comprises a handle on at least one of the first side or the second side.

Illustration 4. The portable exercise device of any preceding or subsequent illustrations or combination of illustrations, further comprising a biasing member biasing the support towards the second position.

Illustration 5. The portable exercise device of any preceding or subsequent illustrations or combination of illustrations, wherein the support comprises a front end and a back end, wherein the back end is pivotably attached to the base within the support recess, and wherein, in the first position, the front end of the support extends forward from the front end of the base.

Illustration 6. The portable exercise device of any preceding or subsequent illustrations or combination of illustrations, further comprising a cushioning member on at least a portion of the sitting surface.

Illustration 7. An exercise device comprising: a base comprising a front end, a back end, and a top side between the front end and the back end; and a support comprising a front end, a back end, and a top side between the front end and the back end of the support, wherein the support is pivotably attached to the base and movable between a minimum angle and a maximum angle relative to the base, wherein the top side of the base and the top side of the support together define a sitting surface.

Illustration 8. The exercise device of any preceding or subsequent illustrations or combination of illustrations, further comprising a biasing member biasing the support towards the maximum angle.

Illustration 9. The exercise device of any preceding or subsequent illustrations or combination of illustrations, wherein at least one of the minimum angle relative to the base or the maximum angle relative to the base is adjustable.

Illustration 10. The exercise device of any preceding or subsequent illustrations or combination of illustrations, further comprising a handle on the base, wherein the exercise device is portable.

Illustration 11. The exercise device of any preceding or subsequent illustrations or combination of illustrations, wherein the base further comprises a first side and a second side, wherein the support is a first support, and wherein the exercise device further comprises a second support, the second support comprising a front end, a back end, and a top side between the front end and the back end of the support, wherein the second support is pivotably attached to the base between the first support and the second side of the base, and wherein the top side of the second support at least partially defines the sitting surface.

Illustration 12. The exercise device of any preceding or subsequent illustrations or combination of illustrations, wherein the first support and the second support are independently pivotable relative to the base.

Illustration 13. The exercise device of any preceding or subsequent illustrations or combination of illustrations, wherein the top side of the base comprises a support recess, and wherein the support is at least partially positioned within the support recess when the support is at the minimum angle.

Illustration 14. An exercise device comprising: a base comprising a front end, a back end, a first side between the front end and the back end, a second side opposite the front end, and a top side between the front end and the back end; a first support pivotably attached to the base between the front end and the back end; and a second support pivotably attached to the base between the front end and the back end and between the first support and the second side of the base, wherein the first support and the second support each comprise a range of motion relative to the base, and wherein the top side of the base, a top side of the first support, and a top side of the second support together define a sitting surface for a user.

Illustration 15. The exercise device of any preceding or subsequent illustrations or combination of illustrations, wherein the first support is pivotable relative to the base independent from the second support.

Illustration 16. The exercise device of any preceding or subsequent illustrations or combination of illustrations, further comprising a biasing member configured to bias at least one of the first support or the second support relative to the base.

Illustration 17. The exercise device of any preceding or subsequent illustrations or combination of illustrations, wherein the biasing member is configured to bias a front end of the first support upwards relative to the top side of the base.

Illustration 18. The exercise device of any preceding or subsequent illustrations or combination of illustrations, further comprising a first handle of the first side of the base and a second handle on the second side of the base.

Illustration 19. The exercise device of any preceding or subsequent illustrations or combination of illustrations, wherein the range of motion of at least one of the first support or the second support is adjustable.

Illustration 20. The exercise device, wherein the range of motion of the first support is from 0°-30°.

The above-described aspects are merely possible examples of implementations, merely set forth for a clear understanding of the principles of the present disclosure. Many variations and modifications may be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described embodiments, nor the claims that follow.

That which is claimed:

1. A portable exercise device comprising:

a base comprising a front end, a back end, and a top side between the front end and the back end, wherein the top side comprises a support recess extending from the front end to a position between the front end and the back end;

an upper thigh support at least partially positioned within the support recess, wherein the upper thigh support is configured to receive and support an upper thigh of a user, wherein the upper thigh support comprises a range of motion between a first position and a second position relative to the base, wherein, in the first position, the upper thigh support is seated within the support recess, and wherein, in the second position, a back end of the upper thigh support is within the support recess and a front end of the upper thigh support extends upwards and away from the support recess, wherein a top side of the upper thigh support and a portion of the top side of the base define a sitting surface for the user; and a biasing member applying a biasing force against the upper thigh support such that in an unloaded state, the upper thigh support is in the second position.

2. The portable exercise device of claim 1, wherein, in the first position, the upper thigh support extends at a first angle of 0° relative to the base, and wherein, in the second position, the upper thigh support extends upwards at a second angle of 30° relative to the base.

3. The portable exercise device of claim 1, wherein the base further comprises a first side and a second side extending between the front end and the back end, and wherein the portable exercise device further comprises a handle on at least one of the first side or the second side.

4. The portable exercise device of claim 1, wherein the back end of the upper thigh support is pivotably attached to the base within the support recess, and wherein, in the first position, the front end of the support extends forward from the front end of the base.

5. The portable exercise device of claim 1, further comprising a cushioning member on at least a portion of the sitting surface.

6. The portable exercise device of claim 1, wherein a width of the upper thigh support is less than a width of the base.

7. A portable exercise device comprising:

a base comprising a front end, a back end, and a top side between the front end and the back end, wherein a support recess is defined in the top side and extends from the front end to a position between the front end and the back end;

an upper thigh support comprising a front end, a back end, and a top side between the front end and the back end of the upper thigh support, wherein the upper thigh support is configured to receive and support an upper thigh of a user, wherein the back end of the upper thigh support is pivotably attached to the base within the support recess, and wherein the upper thigh support is movable between a minimum angle and a maximum angle relative to the top side of the base, wherein at both the minimum angle and the maximum angle, at least the back end of the upper thigh support is within the support recess; and a biasing member biasing the upper thigh support towards the maximum angle such that in an unloaded state, the upper thigh support is in the maximum angle and the front end of the upper thigh support extends upwards relative to the top side of the base, wherein the top side of the base and the top side of the upper thigh support together define a sitting surface, and wherein the portable exercise device is a handheld portable exercise device.

8. The portable exercise device of claim 7, wherein at least one of the minimum angle relative to the base or the maximum angle relative to the base is adjustable.

9. The portable exercise device of claim 7, further comprising handles on opposing sides of the base and between the top side and a bottom side of the base.

10. The portable exercise device of claim 7, wherein the base further comprises a first side and a second side, wherein the upper thigh support is a first upper thigh support, and wherein the portable exercise device further comprises a second upper thigh support, the second upper thigh support comprising a front end, a back end, and a top side between the front end and the back end of the support, wherein the second upper thigh support is pivotably attached to the base between the first upper thigh support and the second side of the base, and wherein the top side of the second upper thigh support at least partially defines the sitting surface.

11. The portable exercise device of claim 10, wherein the first upper thigh support and the second upper thigh support are independently pivotable relative to the base.

12. A portable exercise device comprising:

a base comprising a front end, a back end, a first side between the front end and the back end, a second side opposite the first side, and a top side between the front end and the back end, wherein a support recess is defined in the top side and extends from the front end to a position between the front end and the back end;

a first upper thigh support pivotably attached to the base between the front end and the back end, wherein at least a back end of the first upper thigh support is within the support recess;

a second upper thigh support pivotably attached to the base between the front end and the back end and between the first upper thigh support and the second side of the base, wherein at least a back end of the second upper thigh support is within the support recess, wherein the first upper thigh support and the second upper thigh support each comprise a range of motion between a horizontally-extending position and an upward-extending position relative to the top side of the base, and wherein the top side of the base, a top side of the first upper thigh support, and a top side of the second upper thigh support together define a sitting surface for a user; and a biasing member configured to bias at least one of the first upper thigh support or the second upper thigh support relative to the base such that in an unloaded state, at least one of the first upper thigh support or the second upper thigh support is in the upward-extending position.

13. The portable exercise device of claim 12, wherein the first upper thigh support is pivotable relative to the base independent from the second upper thigh support.

14. The portable exercise device of claim 12, further comprising a first handle of the first side of the base and a second handle on the second side of the base.

15. The portable exercise device of claim 12, wherein the range of motion of at least one of the first upper thigh support or the second upper thigh support is adjustable.

16. The portable exercise device of claim 12, wherein the range of motion of the first upper thigh support is from 0°-30°.

* * * * *